US005924260A

United States Patent [19]

Austin et al.

[11] Patent Number: 5,924,260

[45] Date of Patent: Jul. 20, 1999

[54] METHODS FOR ANCHORING WITHIN A CHANNEL

[76] Inventors: Barry J. Austin, 211 Emerson St., Houston, Tex. 77006; Paul S. Illick, 3311 Teawick Ct., Houston, Tex. 77068

[21] Appl. No.: 09/004,536

[22] Filed: Jan. 8, 1998

[51] Int. Cl.[6] ..... E04B 1/38

[52] U.S. Cl. ..... 52/698; 403/363

[58] Field of Search ..... 403/230, 263, 403/292, 294, 353, 363, 335, 336; 52/710; 248/317, 297.21

[56] References Cited

U.S. PATENT DOCUMENTS

| | | | |
|---|---|---|---|
| 3,015,897 | 1/1962 | Hopp . | |
| 3,486,726 | 12/1969 | Kindorf et al. | 248/72 |
| 3,522,921 | 8/1970 | Lytle | 248/62 |
| 4,412,756 | 11/1983 | Dunwoodie et al. | 403/363 |
| 4,466,592 | 8/1984 | Janson | 248/225.1 |
| 4,542,871 | 9/1985 | Fortsch | 248/73 |
| 4,708,554 | 11/1987 | Howard | 52/710 |
| 4,767,091 | 8/1988 | Cuny | 248/228 |
| 4,881,707 | 11/1989 | Garfinkle | 248/221.4 |
| 5,078,530 | 1/1992 | Kim | 403/24 |
| 5,156,233 | 10/1992 | Olsen et al. | 182/3 |
| 5,240,213 | 8/1993 | Horcher | 52/710 |
| 5,598,785 | 2/1997 | Zaguroli, Jr. | 104/111 |

*Primary Examiner*—Carl D. Friedman
*Assistant Examiner*—Dennis L. Dorsey
*Attorney, Agent, or Firm*—Mau & Krull, P.A.

[57] ABSTRACT

An anchorage assembly is formed by a first member and a second member. Each member is movable into and out of a channel, but when connected together, the interconnected members resist removal from the channel.

21 Claims, 3 Drawing Sheets

METHODS FOR ANCHORING WITHIN A CHANNEL

FIELD OF THE INVENTION

The present invention relates to methods and apparatus for anchoring one or more members relative to a downwardly opening channel.

BACKGROUND OF THE INVENTION

Those skilled in the art recognize the need to anchor objects and/or people relative to a ceiling or overhead rail. For example, when a building is being constructed, workers are advised to attach a life line or fall arrest line to a secure portion of the building. A preferred anchorage point for such a line is above the worker, so that the line minimally interferes with the worker's movements. Additionally, conduits and wiring are often secured in place at points along the ceiling (or beneath the floor) on each level of a building.

In order to facilitate the aforementioned practices, many builders routinely install channel members in the ceiling during the early stages of construction. In particular, continuous concrete inserts are often embedded in the concrete floors (or ceilings) and thereby available for use as needed. A cross-section of such a prior art insert is designated as 90 in FIG. 5. The insert 90 is generally U-shaped and includes a base wall 94 extending between opposite sidewalls 91 and 92. Exposed or "flush-mounted" walls 95 and 96 are integrally joined to "outer" ends of respective sidewalls 91 and 92 and extend toward one another. Distal walls 97 and 98 are integrally joined to "proximate" ends of respective exposed walls 95 and 96 and extend parallel to one another and toward the base wall 94. The walls of the insert 90 cooperate to define a channel 99 having a relatively smaller channel access width W and a relatively larger channel interior width X.

The insert 90 is known in the industry as a Fastenal 308 stainless steel insert. The insert 90 is made of 12 gauge steel and has a square perimeter which measures 1.625" along each side. The access width W is 0.812 inches, and the interior width is 1.415 inches.

Others have developed devices to anchor within such inserts. One of the design considerations for such devices is that the ends of the channel are typically inaccessible. As a result, the only way into the channel is through the access width. Some of the resulting shortcomings of these prior art devices are that they are (a) relatively complicated in design and/or operation; and/or (b) limited in size by the width of the channel (if they are inserted into the channel and then rotated ninety degrees to a locked position). In cases of complicated design and/or operation, concern may exist regarding whether or not the device will be installed correctly and function properly to support a fall arrest line. In cases of size limitation, concern may exist regarding the susceptibility of the device to failure when subjected to a fall arrest load. In other words, a need remains for a anchorage assembly which is relatively simple to make and use and which is able to support a sufficiently large load.

SUMMARY OF THE INVENTION

The present invention provides an anchorage assembly having a channel engaging length which is significantly greater than the width of the channel. The assembly includes a first member and a second member, each of which is sized and configured to be separately insertable into the channel width and then combined or connected to resist removal from the channel. Additional features and/or advantages of the present invention may become more apparent from the detailed description which follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
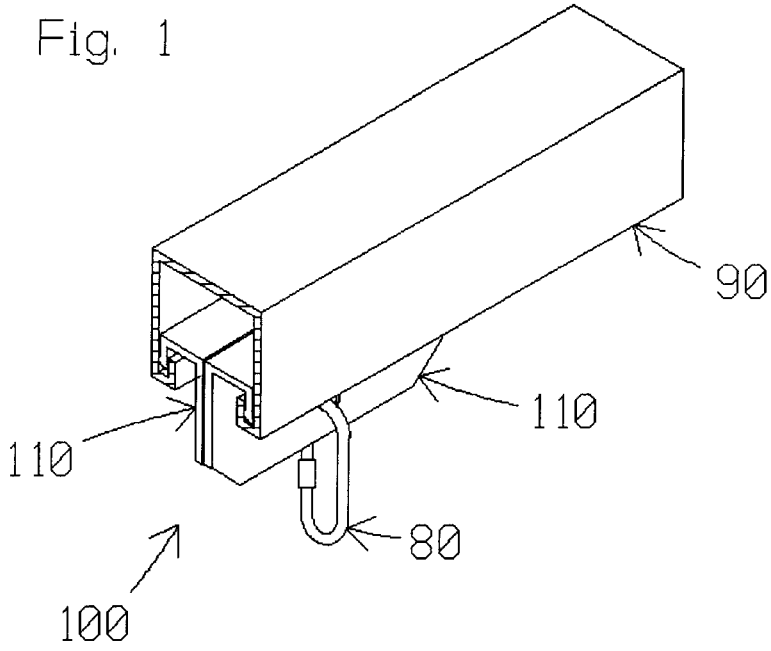
FIG. 1 is a partially sectioned, perspective view of an anchor assembly constructed according to the principles of the present invention and shown in relation to a prior art channel.

An anchor assembly constructed according to the principles of the present invention is designated as 100 in FIG. 1. The assembly 100 cooperates with the prior art channel member or continuous concrete insert 90 to support an object and/or person relative to a ceiling or other overhead support in which the insert 90 is embedded or to which it is secured.

Although the present invention is suitable for use relative to an exposed end of the insert 90, it is specifically designed for use in situations where neither end of the channel 99 is accessible. Therefore, the present invention is described and claimed herein with reference to an "intermediate channel segment" and sectioned portions of the insert 90 (meaning that the access width W is the only available way into or out of the channel 99).

The assembly 100 includes two identical members 110 and a means 80 for interconnecting the two members 110. Those skilled in the art will recognize that the preferred embodiment 100 uses identical members 110 in the interests of manufacturing efficiency, but the present invention is not limited in this regard. Different sizes and/or shapes may be desired under different circumstances.

Figure 4:
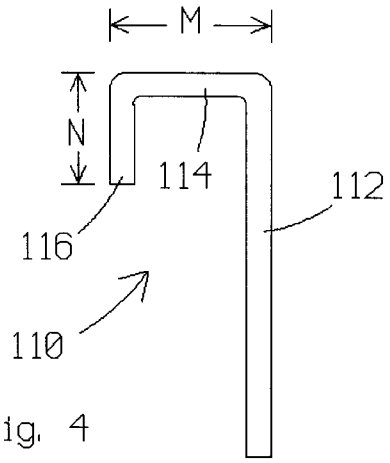
FIG. 4 is an end view of the component shown in FIG. 3.
Figure 3:
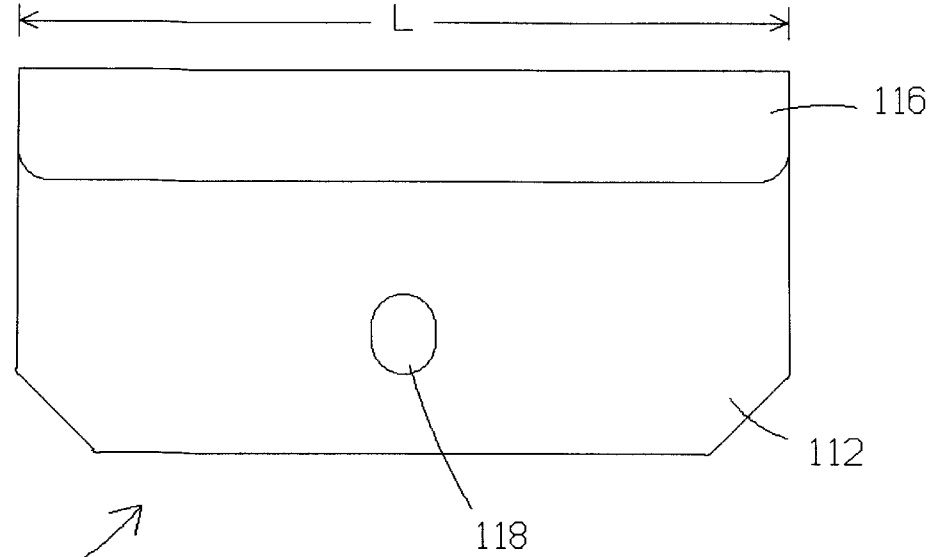
FIG. 3 is a side view of a component of the assembly shown in FIG. 1.

One of the members 110 is shown in FIGS. 3–4 (which are drawn to scale). Each member 110 may be described as a plate of 10 gauge steel which is bent or otherwise manipulated to assume an inverted J-shaped profile. Each member extends a length L perpendicular to this profile. A significant advantage of the present invention is that the length L of the member 110 is neither a function of nor limited by the dimensions of the channel 99. In other words, the length L may be as long as necessary to achieve a desired result. In the embodiment 100, the length L of each member 110 is approximately four inches.

The profile of each member 110 is defined by a relatively longer distal segment 112, an intermediate segment 114, and a relatively shorter distal segment 116. The distal segments 112 and 116 extend in parallel fashion away from opposite ends of the intermediate segment 114. The length of the longer distal segment 112 is approximately two inches; the length M of the intermediate segment 114 (which also may be described as the width of the profile) is approximately eleven-sixteenths of an inch; and the length N of the shorter distal segment 116 is approximately one-half of an inch.

Although both of the dimensions M and N on the members 110 are smaller than the channel access width W, only one of these dimensions must be sized in this manner in order to practice the present invention. Those skilled in the art will also recognize that the profile width M is almost one-half the channel access width W. As a result of these spatial relationships, each of the members 110 may be inserted through the channel access width W and arranged to occupy a discrete half or side of the channel interior width X.

Figure 2:
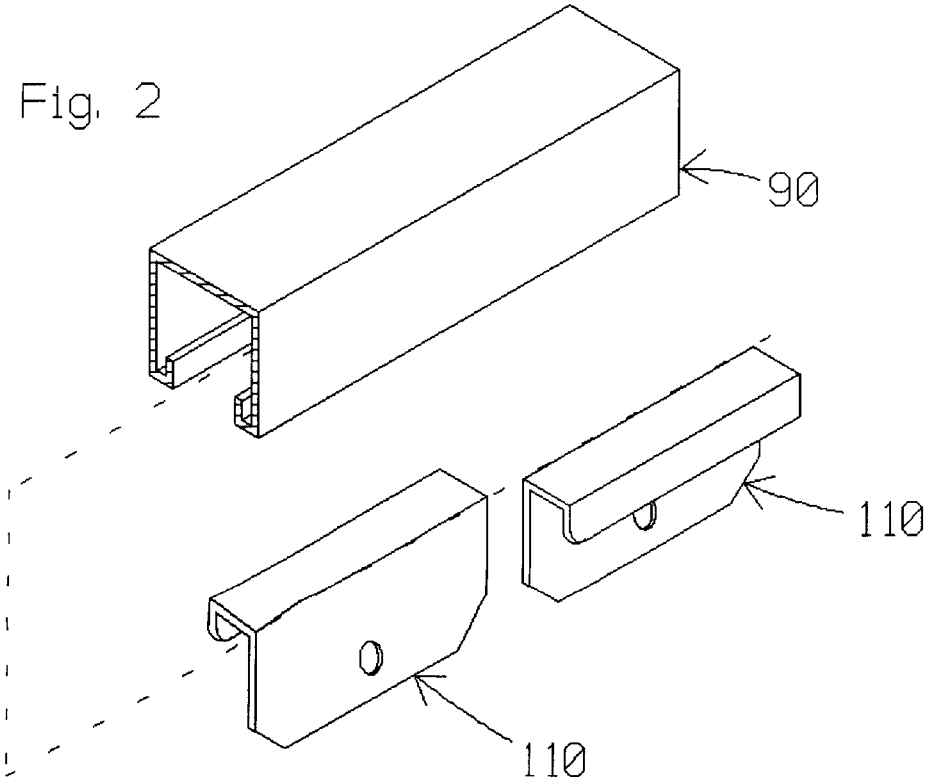
FIG. 2 is an exploded perspective view of components of the assembly shown FIG. 1.

FIG. 2 shows the two members 110 spaced longitudinally apart from one another prior to insertion into discrete portions of the channel defining segment 90. The members 110 are subsequently arranged to occupy a common portion of the channel defining segment 90, with respective longer segments 112 disposed adjacent one another and extending generally parallel to one another and generally perpendicular to the access width W. Oval holes 118 in the longer segments 112 are aligned to receive a carabiner 80 or other suitable fastener. Insertion of the carabiner 80 through the holes 118 effectively locks the two members 110 together and thereby prevents longitudinal movement of either one relative to the other.

The resulting assembly 100 is movable along the channel 99 but resists movement and/or force exerted in a direction generally away from the intermediate segment 114 (including downwardly directed gravitational force). In response to any such external influences, the ends of the shorter segments 116 tend to remain seated in grooves defined between respective walls on the insert 90; portions of the shorter segments 116 press against respective channel walls 91 and 92; and/or portions of the longer segments 112 press against one another.

The present invention may also be described in terms of anchor members 110 having head portions and neck portions. In other words, each member 110 may be said to have a head portion, as defined by the segment 116, the segment 114, and a portion of the segment 112 disposed opposite the segment 116. Each member 110 may also be said to have a neck portion, as defined by the remainder of the segment 112. The width M of each head portion is smaller than the channel access width W and almost one-half as large as the channel interior width X. The head portions may be described as "relatively lengthy" to the extent that the length L is greater than the channel interior width X and/or at least twice as great as the channel access width W.

The present invention may further be described in terms of a method wherein a first member and a second member are anchored relative to an intermediate channel segment of the type having an access width and a relatively larger interior width. The method involves inserting a relatively lengthy head portion on the first member through the access width; inserting a relatively lengthy head portion on the second member through the access width; arranging the first member and the second member so that respective head portions occupy opposite halves of the interior width at a common location along the channel segment; and connecting the first member to the second member.

Figure 5:
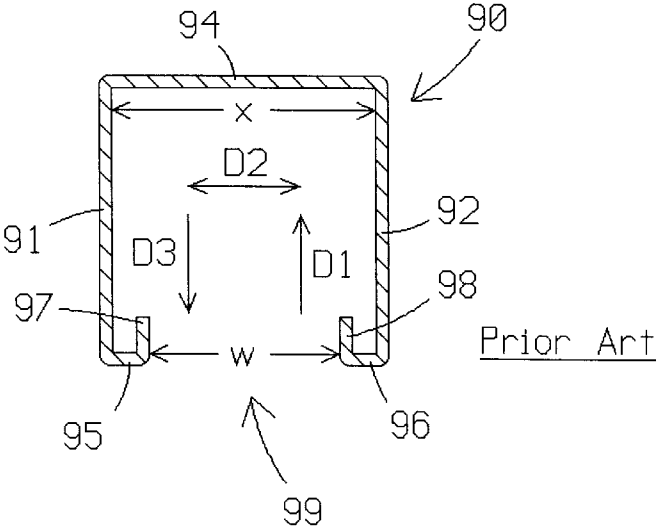
FIG. 5 is an end view of the prior art channel shown in FIG. 1.

The method may also involve inserting the head portion on the first member through the access width at a first location along the channel segment, and inserting the head portion on the second member through the access width at a second, discrete location along the channel segment; moving each head portion in a first direction (D1 in FIG. 5) through the access width, then in a second, perpendicular direction (D2 in FIG. 5) toward a respective side of the channel segment, and then in a third direction, (D3 in FIG. 5) opposite to the first direction and toward a respective lip disposed adjacent the access width; arranging the first member and the second member so that respective neck portions extend away from respective head portions and generally parallel to one another and/or generally perpendicular to the access width; and/or inserting a fastener through aligned holes in the first member and the second member (or through aligned holes in the neck members). The method may also be performed so that the first member and/or the second member occupies a similar orientation during each step of the method.

Figure 6:
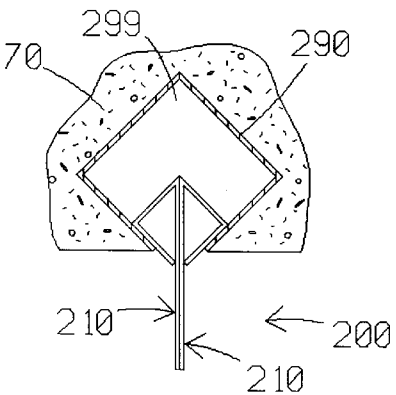
FIG. 6 is a partially sectioned end view of another channel and anchor assembly combination constructed according to the principles of the present invention.

The present invention may also be described with reference to different anchor member configurations and/or different channel configurations. For example, an alternative embodiment anchorage assembly 200 is shown in FIG. 6. The assembly 200 includes two identical anchor members 210 and a fastener (not shown). The assembly 200 cooperates with a diamond-shaped insert 290 which is embedded in concrete 70. The insert 290 defines a channel 299 having a channel access width W' and a channel interior width X'.

Each of the members 210 includes a relatively long segment 212, an intermediate segment 214, and an opposite end segment 216. The segments 214 and 216 cooperate with a portion of the segment 212 to define a head portion. The remainder of the segment 212 may be said to define a neck portion. The head portion has a width (as measured perpendicularly from the segment 212 to the juncture between the segments 214 and 216) which is slightly smaller than the access width W' and substantially smaller than one-half of the interior width X'. Each member 210 may alternatively be described as having a generally P-shaped profile and a length (measured perpendicular to the profile) which is several times greater than the access width W'.

Figure 8:
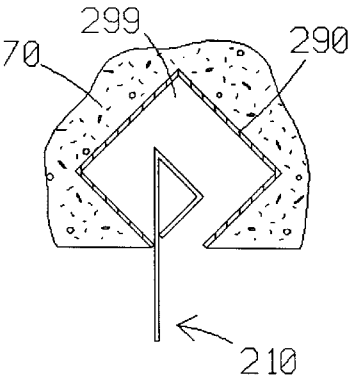
FIG. 8 is a partially sectioned end view of one of the anchor members shown in FIG. 6 subsequent to insertion into the channel shown in FIG. 6.
Figure 7:
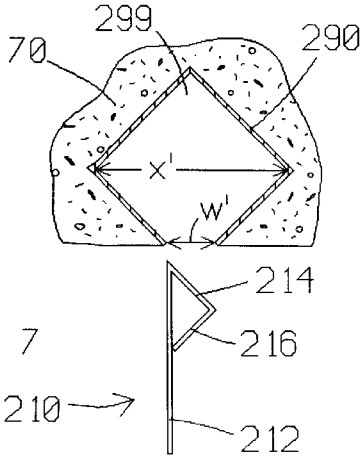
FIG. 7 is a partially sectioned end view of one of the anchor members shown in FIG. 6 oriented for insertion into the channel shown in FIG. 6.

The "right side" member 210 is oriented as shown in FIG. 7, then inserted into the channel 299 as shown in FIG. 8, and then moved toward the "right side" of the channel 299. Those skilled in the art will recognize that this embodiment 200 does not necessarily require that the members 210 be inserted into longitudinally spaced apart portions of the channel 299. The "left side" member 210 is similarly inserted to arrive at the configuration shown in FIG. 6. The fastener is then inserted through aligned holes (not shown) in the neck portions to discourage relative movement of the members 210 (in all directions perpendicular to the access width W'.

Figure 9:
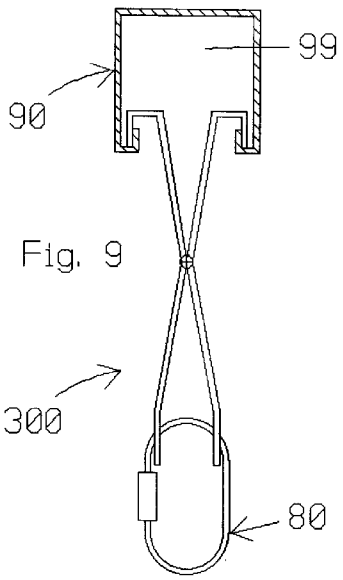
FIG. 9 is a partially sectioned end view of yet another channel and anchor assembly combination constructed according to the principles of the present invention.

Yet another embodiment of the present invention is designated as 300 and shown relative to a conventional insert 90 in FIG. 9. The assembly 300 includes two members 310 which are interconnected by means of a hinge 380 and a fastener 80. Each member 310 may be described as an unitary member having an anchor portion (disposed on one side of the hinge 380) and an actuator portion (disposed on an opposite side of the hinge 380).

Each anchor portion is similar to the anchor members 110 described with reference to the first embodiment 100. In particular, an intermediate segment 314 is interconnected between a relatively longer segment 312 and a relatively shorter segment 316. However, in this embodiment 300, the angle defined between the intermediate segment 314 and the longer segment 312 is obtuse. Also, the combined width of both head portions is slightly less than the access width W of the channel 99.

Figure 11:
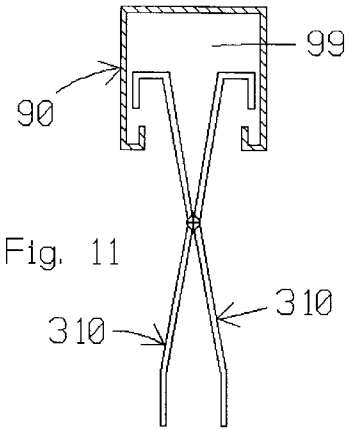
FIG. 11 is a partially sectioned end view of the anchor member shown in FIG. 9 subsequent to insertion into the channel shown in FIG. 9.
Figure 10:
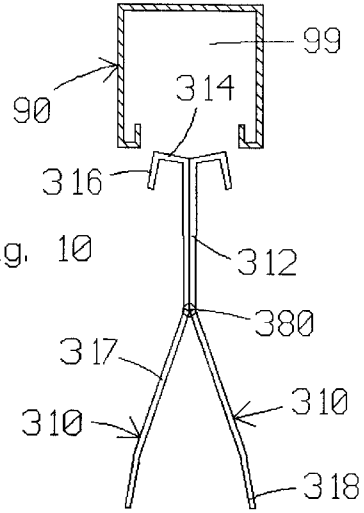
FIG. 10 is a partially sectioned end view of the anchor member shown in FIG. 9 arranged for insertion into the channel shown in FIG. 9.

Each actuator portion includes a first segment 317 and a second segment 318. The first segment 317 is interconnected between proximate ends of the longer segment 312 and the second segment 318. The arrangement of parts is such that the second segment 318 extends generally parallel to the shorter segment 316. Also, since each member 310 is disposed entirely to one side of a plane extending through the hinge 380 and perpendicular to the access width W of the insert 90, movement of the segments 318 toward one another causes movement of the segments 316 away from one another (as suggested by FIGS. 10 and 11).

The assembly 300 is anchored within the channel 99 by first pulling the segments 318 away from one another. A torsion spring or other suitable biasing means may be provided to bias the segments 318 toward one another (and thereby resist this first step). In any event, the heads of the members 310 are moved toward one another and inserted through the channel access width W. The heads of the members 310 are then spread apart and brought into engagement with opposite sides of the channel 99. The carabiner 80 is then inserted through aligned holes in the segments 318 and secured in place. The length of the head portions is greater than the width of the channel 99 and thus, is sufficient to prevent rotation of the assembly 300 relative to the channel 99, which might otherwise result in inadvertent removal of the assembly 300.

Although the present invention has been described with reference to specific embodiments and particular applications, those skilled in the art will recognize that other embodiments and/or applications exist. For example, the present invention is also suitable for supporting conduits, pipes, wiring, and structural members relative to channels disposed within a ceiling or secured to an overhead support. Accordingly, the scope of the present invention should be limited only to the extent of the following claims.

What is claimed is:

1. A method of anchoring a first member and a second member relative to an intermediate channel segment of the type having an access width and a relatively larger interior width, comprising the steps of:

inserting a head portion on the first member through the access width, including a preliminary step of positioning the head portion, which has a length greater than the interior width of the channel segment, so that its length extends generally perpendicular to the access width;

inserting a head portion on the second member through the access width, including a preliminary step of positioning the head portion, which has a length greater than the interior width of the channel segment, so that its length extends generally perpendicular to the access width;

arranging the first member and the second member so that respective head portions occupy opposite halves of the interior width at a common location along the channel segment; and connecting the first member immediately adjacent to the second member.

2. The method of claim 1, wherein the head portion on the first member is inserted through the access width at a first location along the channel segment, and the head portion on the second member is inserted through the access width at a second, discrete location along the channel segment.

3. The method of claim 2, wherein the first member occupies a similar orientation during each step of the method.

4. The method of claim 3, wherein the second member occupies a similar orientation during each step of the method.

5. The method of claim 4, wherein the connecting step involves inserting a fastener through a hole in the first member and a hole in the second member.

6. The method of claim 2, wherein the connecting step involves inserting a fastener through a hole in the first member and a hole in the second member.

7. The method of claim 2, wherein the first member includes a neck portion which extends away from the head portion on the first member, and the second member includes a neck portion which extends away from the head portion on the second member, and the first member and the second member are arranged so that respective neck portions extend parallel to one another.

8. The method of claim 7, wherein the connecting step involves inserting a fastener through a hole in each said neck portion.

9. The method of claim 1, wherein the first member occupies a similar orientation during each step of the method.

10. The method of claim 9, wherein the second member occupies a similar orientation during each step of the method.

11. The method of claim 10, wherein the first member includes a neck portion which extends away from the head portion on the first member, and the second member includes a neck portion which extends away from the head portion on the second member, and the first member and the second member are arranged so that respective neck portions extend parallel to one another.

12. The method of claim 11, wherein the connecting step involves inserting a fastener through a hole in each said neck portion.

13. The method of claim 10, wherein the connecting step involves inserting a fastener through a hole in the first member and a hole in the second member.

14. The method of claim 1, wherein the first member includes a neck portion which extends away from the head portion on the first member, and the second member includes a neck portion which extends away from the head portion on the second member, and the first member and the second member are arranged so that respective neck portions extend generally parallel to one another.

15. The method of claim 14, wherein the connecting step involves inserting a fastener through a hole in each said neck portion.

16. The method of claim 1, wherein the connecting step involves inserting a fastener through a hole in the first member and a hole in the second member.

17. The method of claim 1, wherein the connecting step involves securing a carabiner through a hole in the first member and a hole in the second member.

18. The method of claim 1, wherein the first member includes a neck portion which extends away from the head portion on the first member, and the second member includes a neck portion which extends away from the head portion on the second member, and the first member and the second member are arranged so that respective neck portions extend generally perpendicular to the access width.

19. The method of claim 18, wherein the connecting step involves inserting a fastener through a hole in each said neck portion.

20. The method of claim 1, wherein each head portion is moved in a first direction through the access width, then moved in a second, perpendicular direction toward a respective side of the channel segment, and then moved in a third direction, opposite to the first direction and toward a respective channel wall disposed adjacent the access width.

21. A method of anchoring a first member and a second member relative to an intermediate channel segment of the type having an access width and a relatively larger interior width, comprising the steps of:

inserting a head portion on the first member through the access width, including a preliminary step of positioning the head portion, which has a length greater than the interior width of the channel segment, so that its length extends generally perpendicular to the access width;

inserting a head portion on the second member through the access width, including a preliminary step of positioning the head portion, which has a length greater than the interior width of the channel segment, so that its length extends generally perpendicular to the access width;

arranging the first member and the second member so that respective head portions occupy opposite halves of the interior width at a common location along the channel segment, and a hole through the first member aligns with a hole through the second member; and inserting a fastener through each said hole to connect the first member to the second member.

* * * * *